US005698801A

United States Patent [19]

Meng-Suen

[11] Patent Number: 5,698,801

[45] Date of Patent: Dec. 16, 1997

[54] MUSICAL DISPLAY DEVICE

[75] Inventor: Huang Meng-Suen, Kowloon, Hong Kong

[73] Assignee: Mr. Christmas, Inc., New York, N.Y.

[21] Appl. No.: 535,841

[22] Filed: Sep. 28, 1995

[51] Int. Cl.[6] ..... G10F 1/06

[52] U.S. Cl. ..... 84/101; 84/121; 84/161; 84/94.2; 226/118

[58] Field of Search ..... 226/102, 118, 226/119; 84/94.1, 94.2, 101, 161, 121; 446/298; 40/455

[56] References Cited

U.S. PATENT DOCUMENTS 380,608 4/1888 Thibouville .

908,798 6/1909 McTammany ..... 84/101

5,430,239 7/1995 Chen ..... 84/95.2

*Primary Examiner*—Michael L. Gellner

*Assistant Examiner*—Shih-yung Hsieh

*Attorney, Agent, or Firm*—Fitzpatrick, Cella, Harper & Scinto

[57] ABSTRACT

A musical device for generating music using a tape loop having a plurality of holes a mechanism, which includes a plurality of guide rollers for defining a tape path, for transporting the tape loop along the tape path. A unit for generating music using the plurality of holes in the tape loop is disposed in the tape path. The musical device also includes a device for hindering movement of the tape loop to fold the tape loop.

56 Claims, 8 Drawing Sheets

MUSICAL DISPLAY DEVICE

BACKGROUND OF THE INVENTION

1. Field of the Invention

The present invention relates to a musical display device, and more particularly relates to a musical display device that generates music using a tape loop having a plurality of holes.

2. Description of the Prior Art

Display devices are often used to enhance the decor of homes, offices, commercial establishments, and the like, especially during the holiday seasons. Such display devices sometimes include the ability to generate music to augment their visual appeal. The music may be electronically generated, but many people prefer devices that produce music using a music-box type of mechanism, which produces sounds having different qualities than those which are generated electronically and output from a speaker. Such music-box devices belong to a class of devices referred to as automatic musical instruments. The extent of people's fascination with automatic musical instruments is evidenced by the thousands of such devices shown in the *Encyclopedia of Automatic Musical Instruments* by Q. David Bowers, published by The Vestal Press in 1972.

One common type of musical device uses a tape having a plurality of holes. The tape is fed through a music-box movement of the type disclosed in U.S. Pat. No. 3,691,286, which has a plurality of parallel metal reeds (or tines) of varying lengths and a plurality of disks corresponding to respective reeds and having radial projections on their circumferential edges. As the tape is fed through the music-box movement, projections on the disks are caught in holes in the tape, causing the corresponding disks to rotate so that other projections on the disks engage the corresponding reeds. The projections move the reeds upward and subsequently disengage, allowing the reeds to spring back to their former positions. The vibration of the reeds when they are released generates tones, and the reeds output different tones in accordance with their respective lengths.

The tape may be formed as a strip, a roll, or a loop. The loop form is preferred because the device can play music continuously without having to be reinserted, as does a strip, or rewound, as does a roll. When a tape loop is used, it is common for the loop to have a length greatly exceeding the length of the path that the loop follows, so that the tape loop can play music for a long time before the music begins repeating. Several examples of conventional musical devices using continuous tape loops are shown in the above-mentioned *Encyclopedia of Automatic Musical Instrumental*. In these conventional devices, the excess length of the tape loop is loosely and haphazardly accumulated in a large storage bin. This can lead to problems which detract from enjoyment of the musical device.

For example, the disorderly loops of excess tape take up a large volume of space, thereby requiring a large storage bin to hold them. This creates a problem in reducing the size of the device. Further, the disarray of the excess tape creates the possibility that the tape will become tangled or snagged, which may result in damage to the tape and/or the device. In addition, the random loops impart a sense of sloppiness and are displeasing to the eye, so that the storage bin must be hidden from sight.

Accordingly, an improved device is needed for handling the excess tape in an efficient manner to reduce the necessary storage space, reduce the risk of tangles, and provide a more aesthetically pleasing display.

SUMMARY OF THE INVENTION

The present invention addresses the above-mentioned problems of conventional musical devices that use a tape loop.

For purposes of explanation, the present invention will be described with reference to a musical display device. However, in its broadest aspect, this invention relates to a system capable of producing music using a tape loop, independent of any display.

Accordingly, a principal object of the invention is to provide an improved musical device that is compact and reliable.

Another object of the invention is to provide a musical device that uses a tape loop, in which the excess tape can be stored in an orderly, compact manner.

It is another object of the invention to provide a musical device that dynamically folds the excess portion of the tape loop and unfolds the tape loop as needed.

Still another object of the invention is to provide a musical device that incorporates the tape loop into a display device, so that the tape is an integral part of the display.

Yet another object of the invention is to provide an improved method of generating music using a tape loop.

According to one aspect of the present invention, a musical device comprises a frame having a storage section, a plurality of rollers disposed on the frame to define a tape path, a tape transport unit including a pair of transport rollers and a drive motor coupled to at least one of the transport rollers, a music generation unit disposed in the tape path and comprising a pair of feed rollers for feeding the tape, a feed motor coupled to the feed roller, and a plurality of reeds, and a guide member disposed in the tape path in the storage section and having a restraining portion at one end to hinder the movement of the tape to form accordion-like folds in the tape.

According to another aspect of the present invention, a musical device comprises means for transporting a tape loop along a tape path, including a plurality of guide rollers for defining the tape path, means for generating music using holes in the tape loop, disposed in the tape path, and means for hindering movement of the tape loop to fold the tape loop.

According to still another aspect of the present invention, a musical device comprises a frame including a tape storage section, a tape transport unit for transporting a tape loop along a tape path within the frame, means for generating music disposed in the tape path, and a guide member disposed in the tape storage section, the guide member having a restraining portion for hindering movement of the tape loop.

According to yet another aspect of the present invention, a method for generating music using a tape loop includes the steps of transporting a tape loop along a tape path, feeding the tape loop through a music generation unit disposed in the tape path, and folding a portion of the tape loop to form accordion-like folds.

This brief summary has been provided so that the nature of the invention may be understood quickly. These and other objects, aspects, features and advantages of the present invention will become apparent from the following detailed description of the preferred embodiments taken in conjunction with the accompanying drawings.

DESCRIPTION OF THE PREFERRED EMBODIMENTS

The exterior appearance of the preferred embodiment of a musical device according to the present invention is described with reference to FIG. 1.

Figure 1:
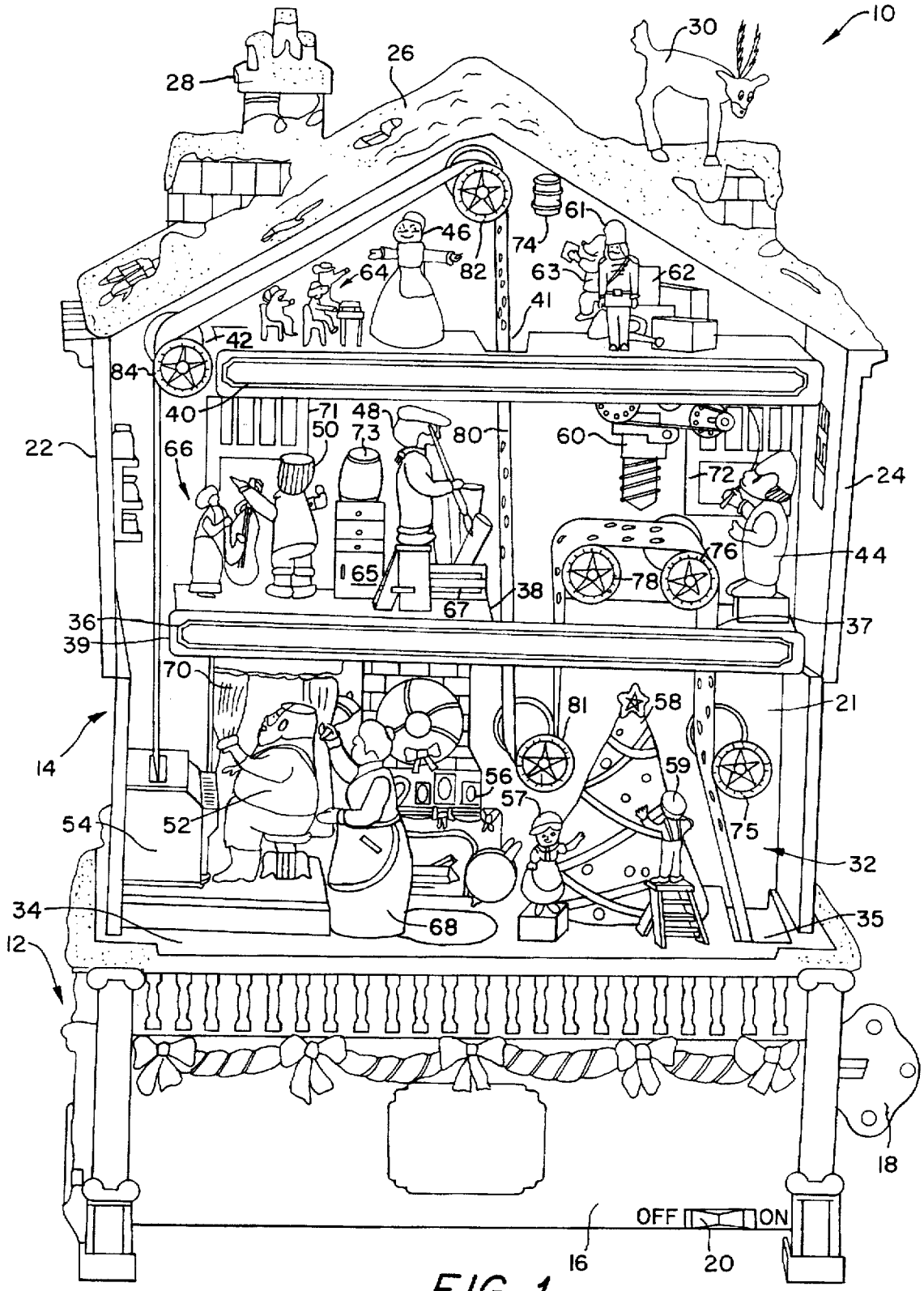
FIG. 1 is a front elevational view of a musical device according to a preferred embodiment of the invention.

As shown in FIG. 1, the musical device has a frame 10 for housing and supporting the components of the device. In the preferred embodiment described herein, the frame 10 is configured to look like a house, but it is not limited to this design. The frame 10 generally includes a bottom section 12, where music is produced using a tape loop and the excess tape loop is gathered, and a top section 14, where a display is depicted and through which the tape loop travels.

The bottom section 12 includes a front panel 16 designed to contribute to the house-like appearance of frame 10. A key-shaped member 18 extends through one side of the bottom section 12 and rotates in a manner described below while music is playing. This gives the appearance that the musical device is operated by winding it using the key. A power jack (not shown) for plugging an AC adapter into the device is provided on the side of the bottom section 12 where the key 18 is located, and an on/off power switch 22 is mounted on the lower right portion of the front panel 16. The AC adapter used in the preferred embodiment converts a 120 V, 11.5 W power supply from a standard wall outlet to an 8 V, 1000 mA power source.

The top section 14 has a back panel 21 to which two side sections 22, 24 and a roof section 26 are attached, all of which are configured to add to the house-like appearance of the frame 10. In particular, the roof section 26 has a peaked shape and a chimney 28. It can also have a reindeer 30 or other figurine perched on top. The roof section 26 and the side sections 22, 24 form the boundary of a main display section 32, which includes three floor sections 34, 36, 40 attached to the back panel 21. The floor section 34 has a visible gap 35 at the right end, the floor section 36 has visible gaps 37, 38, 39, and the floor section 40 has visible gaps 41, 42. The tape loop travels through these gaps, as explained below.

Attached to the three floor sections are a plurality of movable figurines 44, 46, 48, 50, 52. Appendages of the movable figurines, such as the head and one or both arms of each figurine, are moved (using a mechanism described below) while music is playing. Also attached to the three floor sections are a plurality of non-movable features including, for example, a piano 54, a fireplace 56, a girl 57, a Christmas tree 58, a boy 59 on a ladder, a drill 60, a toy soldier 61, packages 62, a mouse 63 holding a package, singing mice 64, a small cupboard 65, instrumentalists 66, a crate 67 holding paper rolls, and Mrs. Claus 68. The back panel 21 is decorated with drapes 70, windows 71, 72, lights 73, 74, and the like, and it may include patterns that look like wallpaper, portraits, shelves, etc. Finally, a plurality of idle guide rollers 75, 76, 78, 81, 82, 84 are attached to the back panel 21 so as to be freely rotatable. Of course, the appearance and specific arrangement of movable and non-movable figurines can be varied to produce a desired visual effect.

Figure 2:
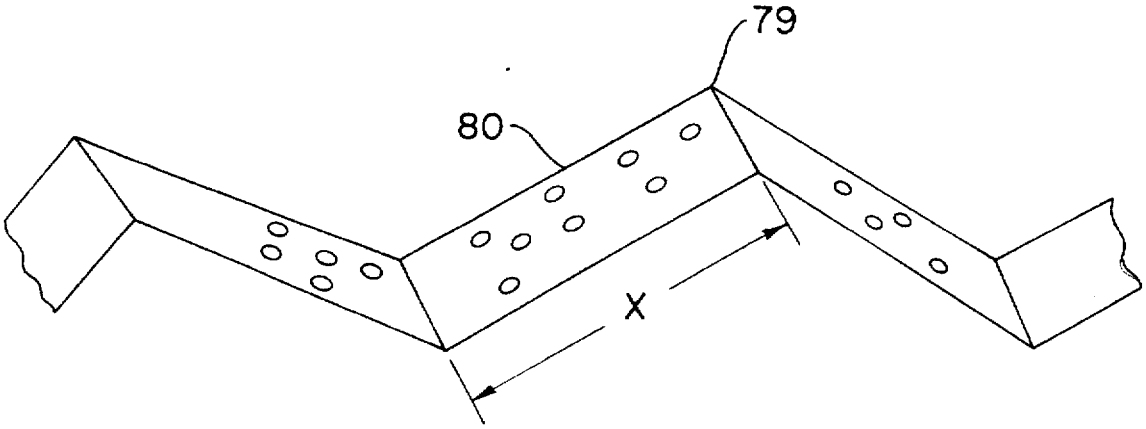
FIG. 2 is a perspective view showing a portion of a tape loop.

FIG. 2 shows a section of a tape loop 80 used in the musical device. The tape loop 80 has holes in it for actuating metal reeds or tines, as discussed below, and has periodic creases 79 on alternate sides of the tape, to aid in folding the tape. The creases or folds 79 are spaced apart by an equal distance X. In the preferred embodiment, the distance X is about 3.5 inches and the tape loop 80 is made of paper. Other materials can be used, of course, but the tape loop 80 should be sufficiently durable so that it does not easily tear, and sufficiently flexible to follow a preferred tape path. Both sides of the tape loop are decorated with musical staffs and notes.

The tape loop 80 serves dual purposes. The first purpose is to provide a medium for storing information regarding music to be played by the musical device. The holes in the tape loop 80 produce music when the tape passes through a music generation unit similar to the music-box movement discussed above with respect to U.S. Pat. No. 3,691,286. The structure for generating music is discussed in detail below. In the disclosed embodiment, the tape loop stores the music for fifteen Christmas carols.

The other purpose of the tape loop 80 is to form an integral part of the visual display in the main display section 32. This feature is best seen in FIG. 1. As the tape loop is transported through the main display section by drive rollers discussed below, it follows a tape path defined by the idle guide rollers 75, 76, 78, 81, 82, 84. The idle guide rollers are arranged to guide the tape loop along the tape path in close proximity to each of the movable figurines 44, 46, 48, 50, 52, so that a portion of the tape loop 80 is adjacent to each movable figurine.

In the preferred embodiment, the tape loop 80 passes through the gap 35 in the floor section 34, past the roller 75, and through the gap 37 in the floor section 36. The tape passes over rollers 76 and 78, down through the gap 38 in the floor section 36, under and around the roller 81, and back up through the gap 38 in the floor section 36 and through the gap 41 in the floor section 40. The tape then passes over rollers 82 and 84, and down through the gap 42 in the floor section 40, through the gap 39 in the floor section 36, through the piano 54, and through a gap in the floor section 34 that is hidden by the piano 54. As described in greater detail below, the movable figurines 44, 46 48, 50, 52 will appear to interact with the tape loop 80 as it is travels through the main display section 32, due to the movement of those figurines and their close proximity to the moving tape loop.

The structure for generating music using the holes in the tape loop 80 is described with respect to FIGS. 3 through 6.

Figure 3:
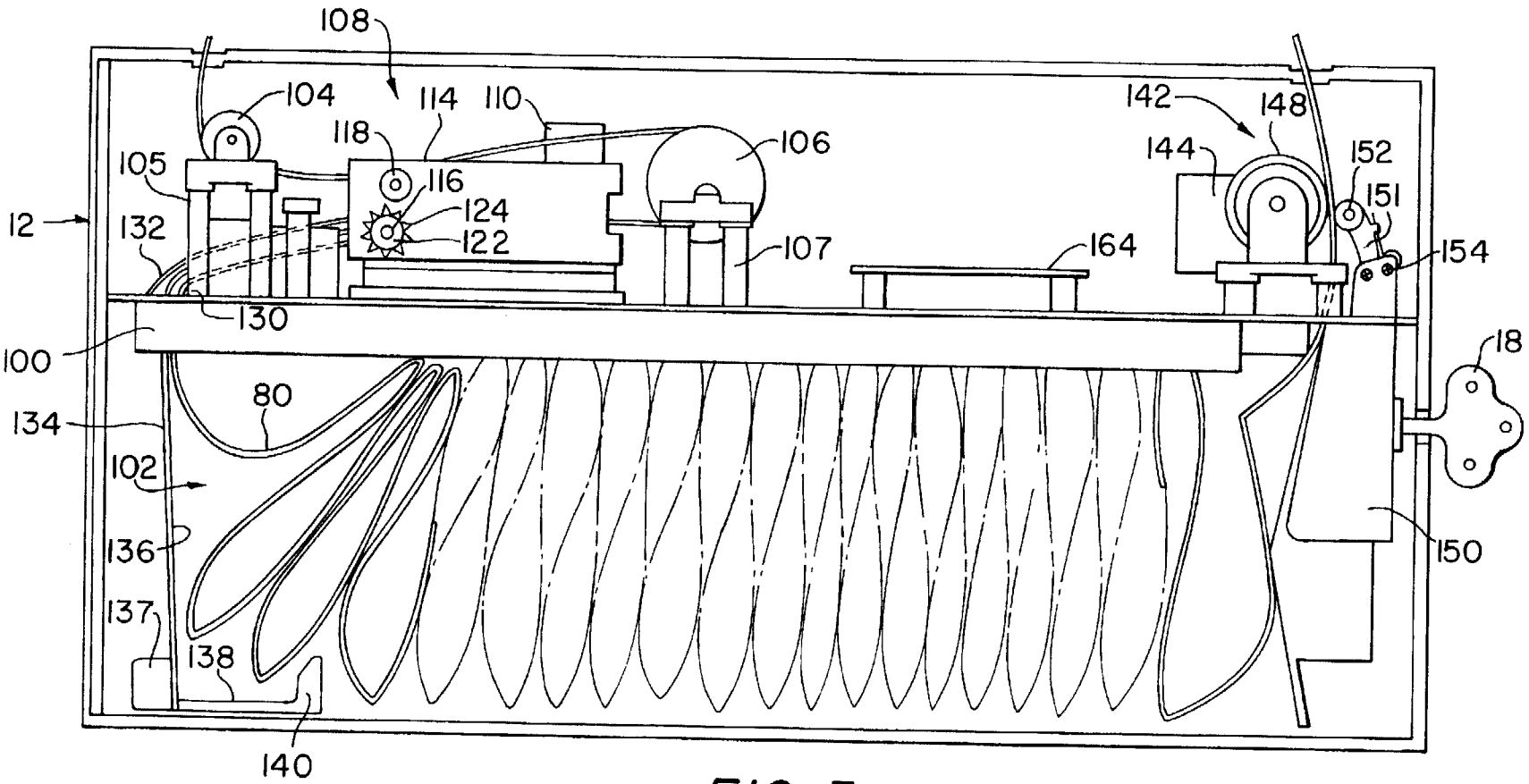
FIG. 3 is a partial front elevational view of a bottom frame section of the musical device with a front panel removed.

Although a preferred structure is described, various other structures for generating music using holes in a tape loop may be used without departing from the scope of the invention. As shown in FIG. 3, behind the front panel 16 of the bottom section 12 is a support plate 100, which supports the structure for generating music and the structure for transporting the tape loop 80, and which serves as the upper boundary of a storage section 102. The storage section has a height slightly greater than the distance X between creases in the tape loop.

Figure 4:
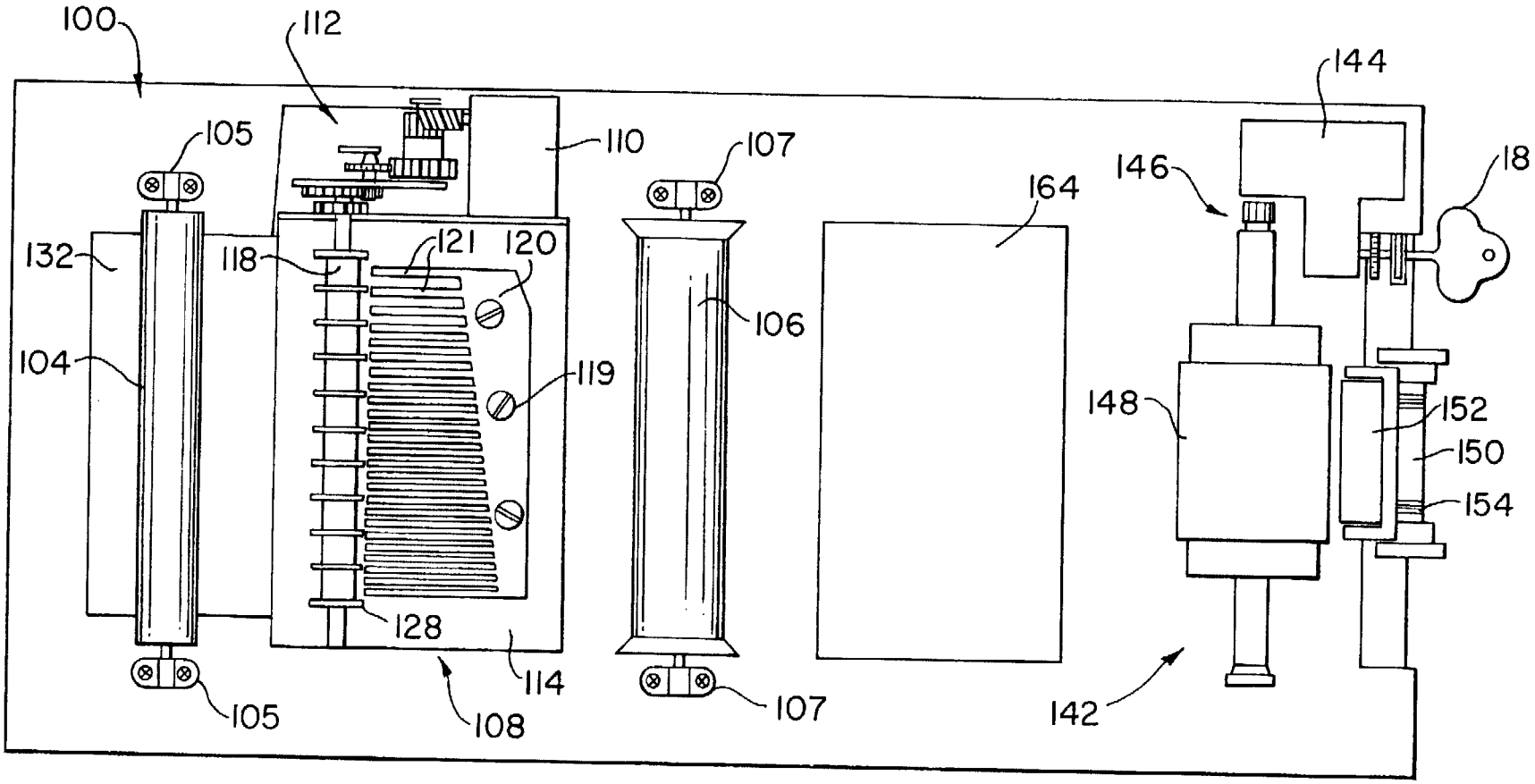
FIG. 4 is a top plan view illustrating components mounted on a support plate.

FIG. 4 provides a top view of the support plate 100 and, together with FIG. 3, shows the components mounted on the support plate. As these figures illustrate, positioning rollers 104, 106 are each mounted on a respective pair of roller mounting members 105, 107 that are attached to the support plate 100 on either side of a music generation unit 108. The portion of tape loop 80 passing through the piano 54 and the floor section 34 wraps under and around the positioning roller 104, passes over the music generation unit 108, and then passes over and back around beneath positioning roller 106 to position the tape for passage through the music generation unit 108.

Figure 5:
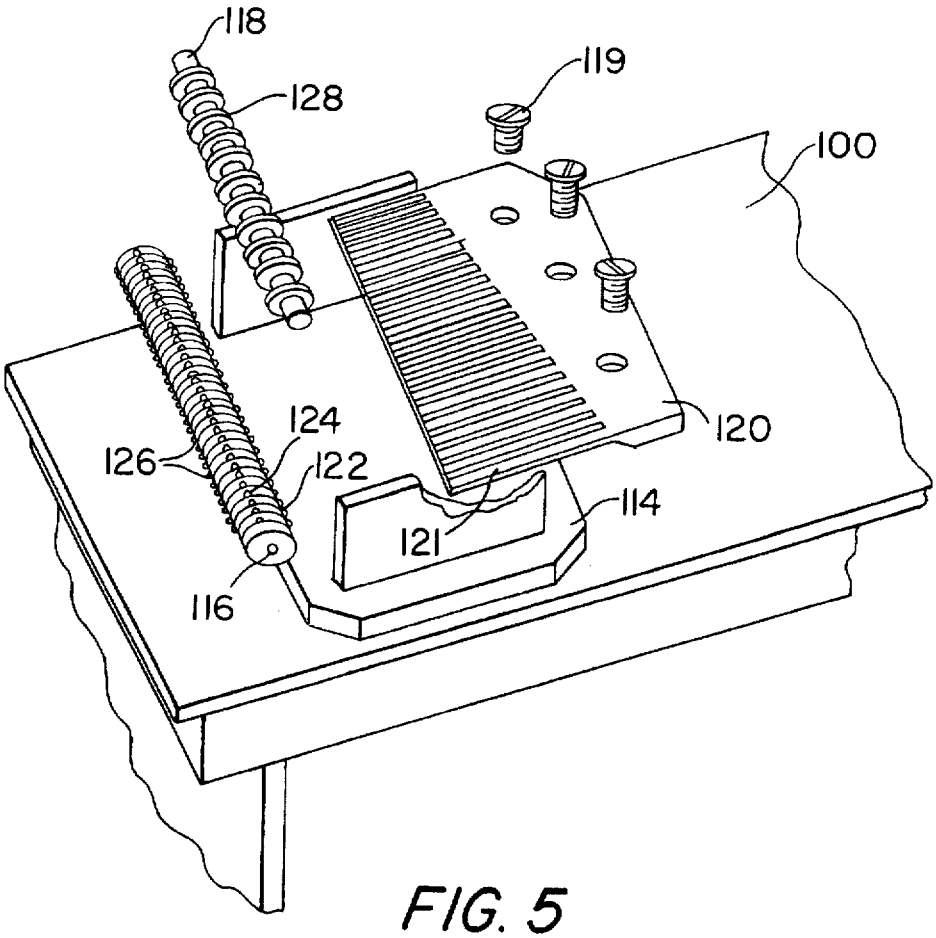
FIG. 5 is a partially exploded perspective view of a portion of the music generation unit.

The music generation unit 108 includes a frame 114 which supports a lower feed roller 116, an upper feed roller 118, and a comb 120. The comb 120 has a plurality of reeds or tines 121 which have varying lengths and are made of metal in the preferred embodiment. The comb is attached to the frame 114 by three screws 119. As best seen in FIG. 5, the lower feed roller 116 has a plurality of disks 122 which are mounted at positions corresponding to respective reeds and which can rotate independently of the lower feed roller. The disks 122 have circumferentially spaced projections 124 and are separated by contact areas 126. The upper feed roller 118 has a plurality of disks 128 integrally formed in it at positions corresponding to the contact areas 126 of the lower feed roller 116. The music generation unit also has a motor 110 coupled to both feed rollers via a gear train 112, to cause both feed rollers to rotate. Preferably, the motor is a DC motor, but an AC motor can be used. The gear train is arranged to convert the rotational speed of the motor's output shaft to a desired speed for rotating the upper and lower feed rollers, and those skilled in the art will appreciate that many configurations of gears can achieve that result.

After passing around the positioning roller 106, the tape loop 80 passes over the comb 120 and between the upper and lower feed rollers, and is pinched between the disks 128 of the upper feed roller 118 and the contact areas 126 of the lower feed roller 116. In this manner, the tape loop is fed through the music generation unit 108 as the motor 110 drives the upper and lower feed rollers. When a hole is present in the tape loop 80 at a position corresponding to one of the disks 122, the hole engages one of the projections 124 on that disk and the disk is rotated by the movement of the tape loop. As the disk 122 rotates, another one of the projections 124 on that disk will engage the corresponding one of the reeds 121 and lift it upward. After the disk 122 rotates further, the projection 124 engaging the reed 121 will disengage, and the reed 121 will spring back to its original position and produce a tone. The pitch of the tone produced varies inversely to the length of the reed.

With reference to FIG. 3, a pair of curved guide plates 130, 132 are disposed at the point where the tape exits the music generation unit 108, between the pair of roller mounting members 105. The guide plates 130, 132 form a path between them which guides the tape downward through a gap in the support plate 100.

A guide member 134, which is substantially L-shaped, is disposed in the storage section 102 and has one end attached to the bottom surface of the support plate 100. The guide member 134 has a first section 136 that extends vertically from the end attached to the support plate 100 to a 90° bend or angle near the bottom of the storage section 102. A second section 138 extends horizontally from the first bend to a second 90° bend or angle. A third section 140 extends upward vertically from the second bend to the other end of the guide member 134. In the preferred embodiment, the first section is about 3.25 inches long, the second section is much shorter, about 1 inch long, and the third section is even shorter, about 0.375 inch long. The guide member 134 also has a tab 137 protruding from the first section 136 near the second section 138, which braces the guide member against the side of the lower section 12 of the frame 10.

The portion of the tape loop 80 coming into the storage section 102 slides downward along the surface of the first section 136. The tape loop 80 will then slide along the surface of the second section 138 a short distance, but is restrained by the third section 140 from moving further into the storage section 102.

Since the third section 140 hinders movement of the tape loop 80, the tape loop is forced to fold itself along the creases in the tape. As a result, accordion-like folds are formed in the tape loop 80, with the folded edges alternately facing the top and bottom portions of the storage section 102. As the tape loop is folded, the folds will be supported on or suspended above the second section 138 of the guide member 134. When several folds have accumulated, the folds nearest the first section 136 of the guide member will exert a force on the folds nearest the third section 140. Consequently, the fold or folds nearest the third section will slide over the third section and move into the main area of the storage section 102. In the preferred embodiment, the surface of the third section 140 that faces the first section 136 is curved to aid the accumulated folds in sliding over the third section.

By this arrangement, accordion-like folds are formed in the tape loop 80 as it enters the storage section 102, and the folds migrate across the storage section to the other side, where the tape is fed out of the storage section. Although a particular structure has been described for the guide member 134, the guide member is not limited to this structure and may have other configurations that fold the tape loop along the creases. Further, although the folded portions of the tape loop 80 are concealed behind the front panel 16 in the preferred embodiment, the folded portions of the tape loop may also be exposed. This may add an additional dimension of interest to the device, since an observer can watch the folded tape migrate through the storage section 102. In particular, the folded tape may augment the visual aspects of the display if the edges of the tape loop are colored different colors, which highlight the movement of different sections of the tape loop through the device.

A transporting unit 142 for feeding the tape loop 80 out of the storage section 102 and back into the main display section 32 is mounted on the support plate 100 at an end opposite where the music generation unit 108 is mounted. The transporting unit 142 includes a motor 144, a gear train 146, a first drive roller 148 mounted on the support plate 100, a support member 150, and a second drive roller 152 mounted on the support member 150. A portion of the support member 150 extends below the support plate 100 and serves as a guide surface to guide the tape loop 80 out of the storage section 102 through a gap in the support plate 100. The second drive roller 152 is mounted on a support bracket 151 that is pivotably attached to the support member 150 at a position opposing the first drive roller 148, and is biased by a spring 154 toward the first drive roller. The tape loop 80 is pinched between the first and second drive rollers, which are preferably covered with rubber or the like to increase friction, and is transported when the motor 144 rotates the first drive roller 148 via the gear train 146.

Figure 6:
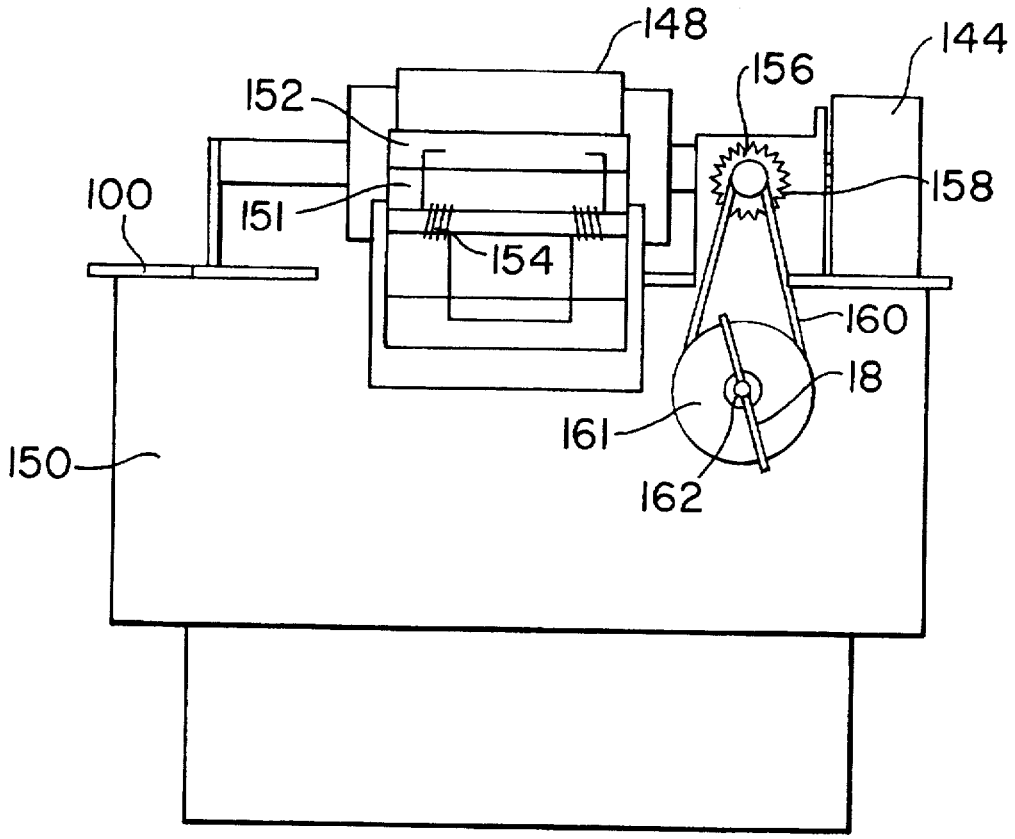
FIG. 6 a side elevational view of one end of the bottom section of the frame.

As shown in FIG. 6, the motor 144 also rotates a gear 156 which turns a pulley 158. A belt 160 couples the pulley 158 to another pulley 161 so that the pulley 161 also rotates. The pulley 161 is formed around a holder 162 which holds the end of the key 18. Accordingly, when motor 144 operates to transport the tape loop 80, the holder 162 is rotated so that the key 18 turns.

Also mounted on the support plate 100 is a circuit board 164, which contains a conventional circuit including resistors, capacitors, and transistors for converting an AC power source to a DC power source. Wires (not shown) connect the power jack and power switch 20 to the circuit board 164 and distribute power to the motor 110, the motor 144, and a circuit board mounted on the rear of back panel 21, which is discussed below.

The elements shown in outline or block form in the drawings are well-known to those of ordinary skill in the art of musical display devices and the details thereof are not critical to an understanding of the present invention.

Figure 7A:
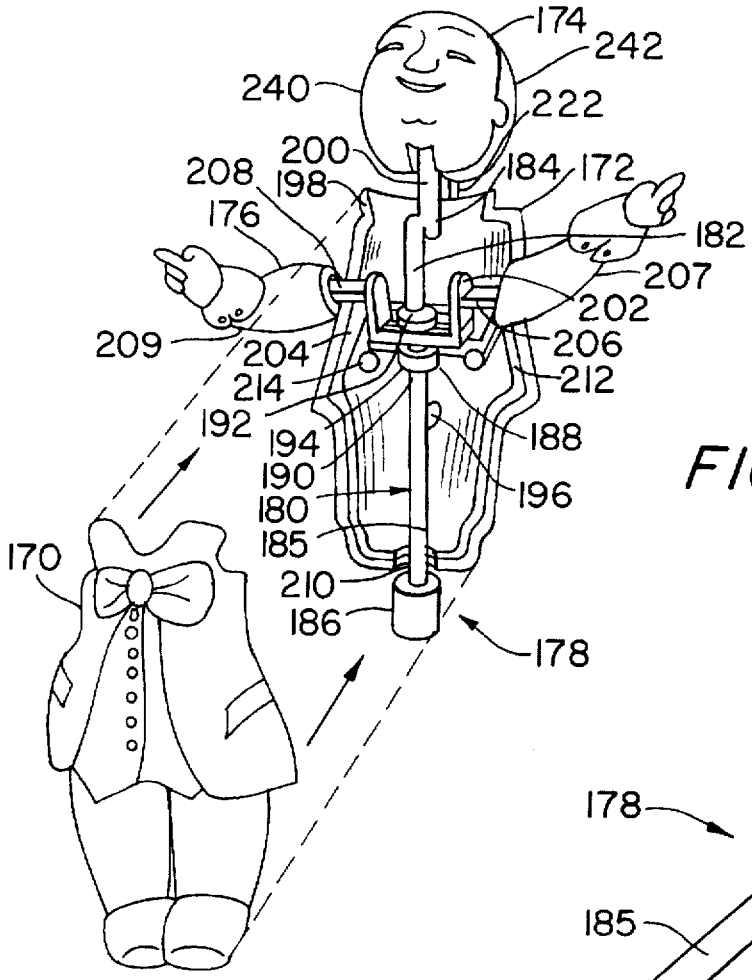
FIG. 7A is a partially exploded perspective view of a movable figurine.

The structure for moving the movable figurines 44, 46, 48, 50, 52 is described with respect to FIGS. 7A through 10. While a preferred mechanism is described, other comparable arrangements for moving figures may naturally be used as well. FIG. 7A shows a view of one of the movable figurines. The figurine includes a front section 170, a back section 172, a head 174, an appendage member 176, and a central shaft 178.

Figure 7B:
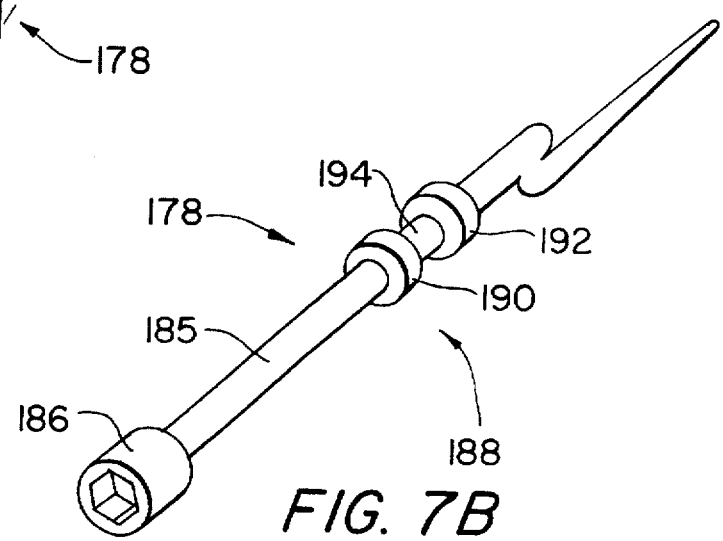
FIG 7B is a perspective view of a central shaft of the movable figurine shown in FIG. 7A.

The central shaft 178 has a first section, a second section 182, and a third section 184. The first section 180 comprises a rod 185 having a cylinder 186 formed coaxially at one end, and a collar 188 formed coaxially at the other end. As shown in FIG. 7B, a cross-section of the cylinder 186 has a hexagonal inner shape. The collar 188 comprises a first disk 190, a second disk 192, and a short rod 194 coaxial with the rod 185 sandwiched between the first and second disks. The rod 185 also has a tab 196 attached near the end at which the collar 188 is formed. The second section 182 of the central shaft comprises a rod 198 attached to the disk 192 of the collar 188 so that the axis of the rod 198 is parallel to, but offset from, the axis of the rod 185. The third section 184 comprises a rod 200. One end of the rod 200 is attached to the end of rod 198 so that the axis of rod 200 is parallel to but offset from that of rod 198. The other end of rod 200 is tapered and fits into the head 174 as described below.

The appendage member 176 has a frame 202 having a rectangular opening 204. Two posts 206, 208 extend laterally from the frame 202 in opposite directions, and arm members 207, 209 are respectively attached to the posts 206, 208. Of course, the appendage member 176 can have other configurations and is not limited to having two movable arms. The figurine back section 172 has a shaft groove 210, two engagement pins 212, 214, a collar groove (not shown) located between the two engagement pins, two appendage grooves on opposite sides of the back section 172 at positions corresponding to the posts 206, 208, and a pivot shaft 222 (best seen FIG. 7C) that extends upward from the top of the back section and terminates in a T-shaped pivot head 224. The front section 170 has a corresponding shaft groove, a collar groove located between two engagement holes for receiving the engagement pins 212,214, and appendage grooves.

When the front and back sections are mated together, the grooves in the two sections match up to hold in place the lower part of the rod 185, the collar 188, and the posts 206, 208. The second section 182 of the central shaft 178 passes through the rectangular opening 204 of the appendage member frame 202. When the central shaft is rotated, the rod 198 of the second section presses against one side of the frame 202 and causes the appendage member 176 to rock in a first direction. As the central shaft is further rotated, the rod 198 presses against the opposite side of the frame 202 and the appendage member is rocked in the opposite direction. In this manner, the appendage member 176, which includes a pair of arms in this embodiment, rocks back and forth as the central shaft 178 rotates.

Figure 7C:
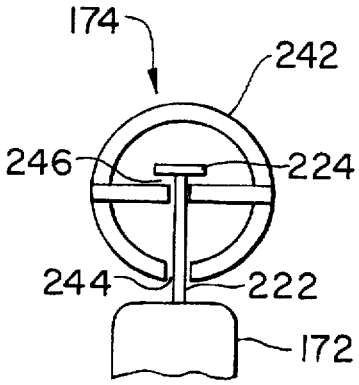
FIG. 7C is an elevational view of a back section of the head of the figurine shown in FIG. 7A.
Figure 7D:
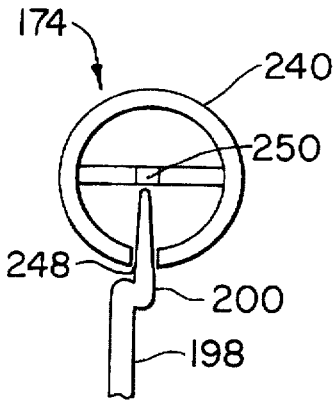
FIG. 7D is an elevational view of a front section of the head of the figurine shown in FIG. 7A.

As shown in FIGS. 7C and 7D, the head 174 has a front section 240 and a back section 242. The back section 242 has a pivot shaft groove 244 and a notch 246. The front section 240 has a central shaft groove 248 and a projection 250. The pivot shaft 222 extends through the pivot shaft groove 244 and the notch 246 so that the pivot head 224 rests on top of the notch 246. When the front section 240 is attached to the back section 242, the projection 250 locks the pivot shaft 222 into the notch 246 so that the pivot head 224 is locked above the notch 246 and holds the head 174 on the figurine. The tapered end of the rod 200 in the third section of the central shaft 178 fits into the central shaft groove 248. When the central shaft is rotated, the end of the rod 200 traces a circular path in which it presses against opposite sides of the central shaft groove 248 and causes the head 174 to wobble on the pivot shaft 222.

Figure 8:
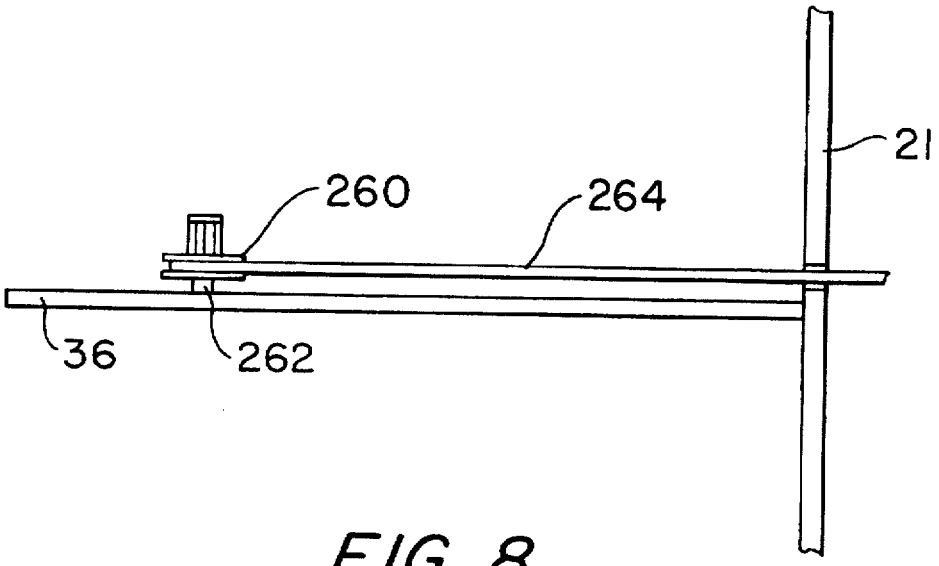
FIG. 8 is a partial side elevational view showing a portion of the mechanism for rotating the central shaft of a movable figurine.
Figure 9:
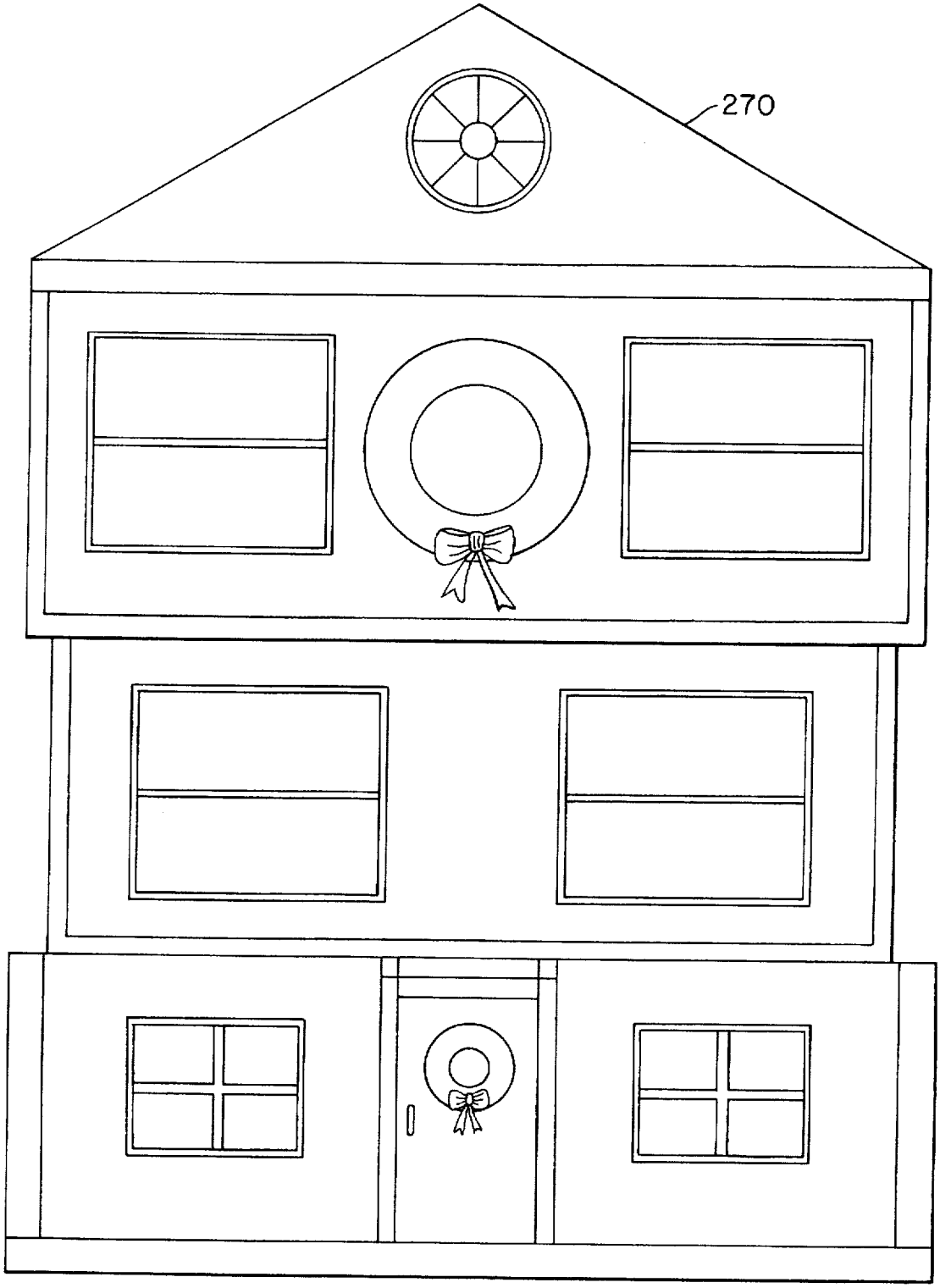
FIG. 9 is a rear elevational view of the musical device.
Figure 10:
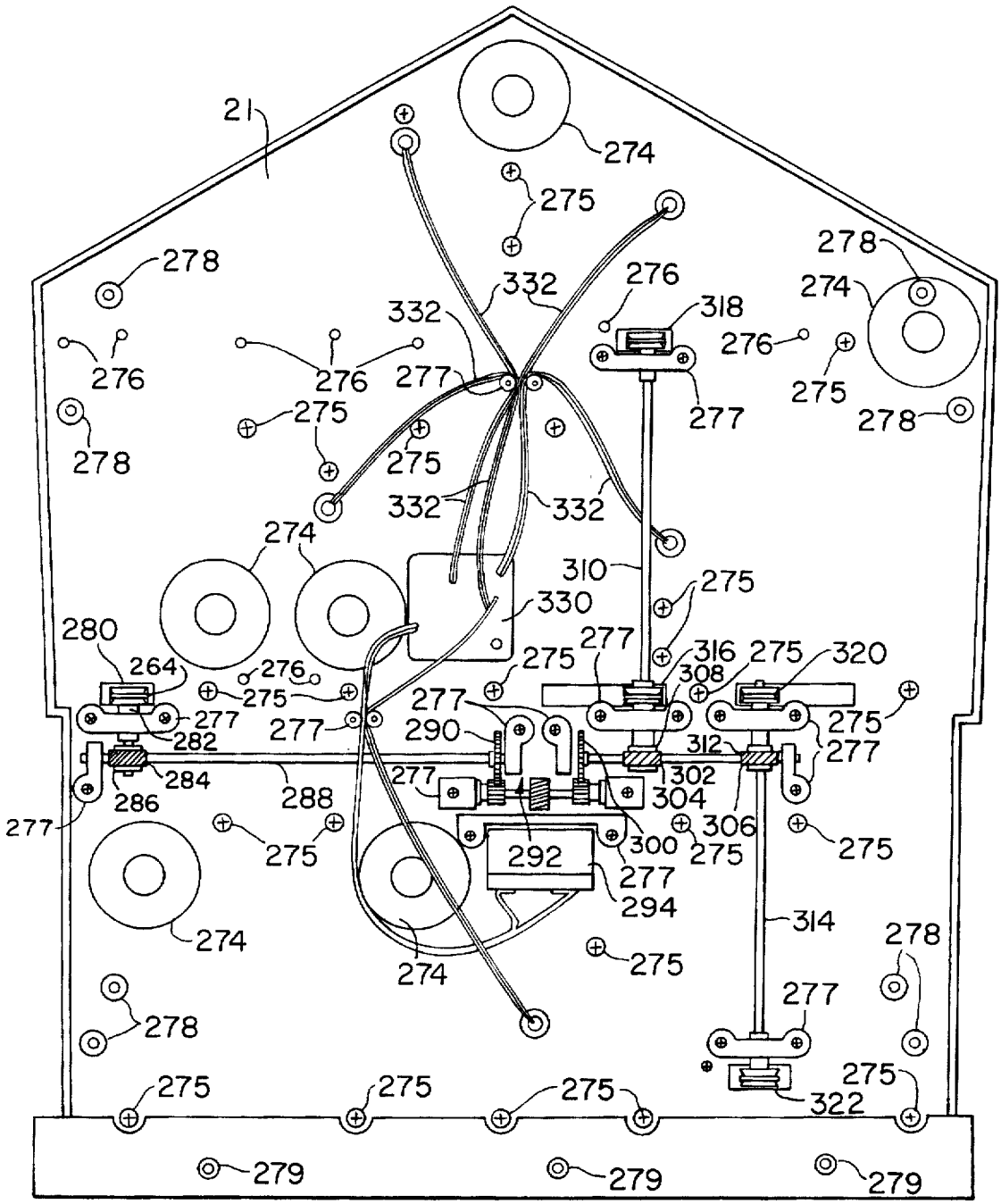
FIG. 10 is a rear elevational view of the musical device with a rear panel removed.

The structure for rotating the central shafts of the figurines is described with respect to FIGS. 8 through 10. As shown in FIG. 8, a driven pulley 260 is horizontally disposed so that it is rotatably supported inside a floor section, e.g., the floor section 36, by a lower portion of an axial shaft 262. The upper portion of the axial shaft 262 has a hexagonal shape and fits into the cylinder 186. An endless belt 264, which is preferably made of rubber, passes around the driven pulley 260. The endless belt 264 extends through a gap in the back panel 21 and around a drive pulley, as discussed in detail below.

FIG. 9 shows a rear view of the musical device. A rear house panel 270 covers the back side of the device and is configured to provide a house-like appearance. FIG. 10 shows a rear view of the device in which the rear house panel 270 is removed to expose the back side of the back panel 21. As shown in FIG. 10, the back panel 21 has a plurality of roller mounting shafts 274 which extend through the back panel 21 and project from its front side. The idle guide rollers 75, 76, 78, 81, 82, and 84 slide onto these mounting shafts. The back panel 21 also has a plurality of screws 275 that attach various items, such as window 70, fireplace 56, and the like, to the front side of the back panel 21, and a plurality of through-holes 276, into which pins formed at the back of the floor section 36 and the floor section 40 fit. Also shown in FIG. 10 are a plurality of mounting members 277 screwed to the back panel 21 to attach rods, shafts, wires, a motor, etc., which are discussed below. In addition, a plurality of mounting posts 278 for attaching the rear panel 270 are shown, as well as a plurality of screw holes 279 for attaching the back panel 21 to the bottom section 12 of the frame 10.

The remaining components shown in FIG. 10 are used to rotate the movable figurines. A drive pulley 280 is attached to the back side of the back panel 21 so as to be rotatably supported by an axial shaft 282. The endless belt 264 extending through a gap in the back panel passes around the drive pulley 280, so that rotation of the drive pulley 280 is coupled to rotation of the driven pulley 260. A worm gear 286 is attached to the end of axial shaft 282. The worm gear 286 meshes with a worm gear 284 attached to the end of a rod 288. A gear 290 is coaxially attached to the opposite end of rod 288 and meshes with a gear train 292. The gear train 292 is driven by a motor 294. When the gear train 292 is rotated, the gear 290 rotates which causes the rod 288 and the worm gear 284 to rotate. The rotation of the worm gear 284 causes the worm gear 286 to rotate, which rotates the axial shaft 282 and the drive pulley 280. The endless belt 264 moves as the drive pulley 280 rotates, causing the driven pulley 260 to also rotate. This causes the axial shaft 262 to rotate and turn the central shaft 178 of the movable figurine.

As shown in FIG. 10, the gear train 292 also meshes with a gear 300 coaxially attached to a rod 302, and causes rotation of the rod 302 when the motor 294 operates. Worm gears 308, 312 are mounted on rod 302 and respectively engage with a worm gear 304 on a rod 310 and a worm gear 306 on a rod 314. The rod 310 has drive pulleys 316, 318 mounted at opposite ends, and the rod 314 has drive pulleys 320, 322 mounted at opposite ends. Each of the drive pulleys 316, 318, 320, 322 moves an endless belt extending through the back panel 21 to move one of the movable figurines in the manner discussed above. FIG. 10 also shows that a circuit board 330 is mounted on the back side of back panel 21. The circuit board 330 receives power from the circuit board 164 on the support plate 100, and has a simple circuit that distributes power to the motor 294 and to wires 332 which provide power to lights 73, 74, and other display items mounted on the front side of back panel 21.

As mentioned above, the tape loop 80 is an integral part of the visual display in the main display section 32, in addition to producing music in combination with the music generation unit 108. In particular, referring back to FIG. 1, the guide rollers 76 and 78 are disposed in the same horizontal plane so that the tape loop 80 passes horizontally beneath the drill 60. The movable figurine 44 holds a rope in one hand which is connected to the drill 60. As the arm of the figurine 44 moves, the figure appears to operate the drill to drill the holes in the tape loop 80. The figurine 48 holds a paintbrush in one hand and faces a section of the tape loop 80 stretched between the guide roller 81 and the guide roller 82. As the arm of the figurine 48 moves, the figure appears to paint notes on the tape loop 80. The figurine 46 stands before the singing mice 64, and appears to lead them in song as her arms move. The figurine 50 is a conductor who stands before the instrumentalists 66 and appears to conduct their music as his arms move. Finally, the figurine 52 is Santa Claus seated at the piano 54, who appears to read music as the tape loop 80 passes through the piano 54 and appears to play the piano as his arms move.

The structure of the above-described preferred embodiment of a musical device provides a device in which a long tape loop containing music for playing a number of songs is neatly and compactly folded as the excess tape passes through a storage section, while at the same time the tape loop is an integral part of a visual display in which movable figurines appear to interact with the tape loop. Although the preferred embodiment is configured to present a Christmas theme, many alternative themes can be produced by merely altering the appearance of the figurines and changing the music.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A musical device comprising:

a frame including a tape storage section;

a plurality of guide rollers disposed on said frame, said guide rollers defining a tape path;

a tape transport unit including a pair of transport rollers and a drive motor coupled to at least one of said transport rollers;

a music generation unit disposed in the tape path, said music generation unit including a pair of feed rollers for feeding a tape through said music generation unit, a tape feed motor coupled to at least one of said feed rollers, and a plurality of reeds arranged to engage holes in a tape being fed by said feed rollers; and a guide member disposed in the tape storage section at a position where the tape path enters the tape storage section, said guide member having a restraining portion comprising an upward projection to hinder horizontal movement of a tape traversing the tape path so that accordion-like folds are formed in the portion of the tape within the tape storage section, wherein said guide member folds the tape within the tape storage section so that folded edges alternately face up and down.

2. A device according to claim 1, further comprising:

a tape having a plurality of holes therein and having periodic creases on alternated sides, said tape forming a continuous loop having a length greater than the length of the tape path.

3. A device according to claim 1, further comprising at least one movable figurine attached to said frame and a figurine motor coupled to said figurine to cause it to move.

4. A musical device according to claim 1, wherein said guide member is substantially L-shaped.

5. A musical device according to claim 1, wherein said guide member include a first guide portion for guiding the tape in a first direction substantially downwardly within the tape storage section and said restraining portion guides the tape in a second direction substantially opposite to the first direction.

6. A musical device comprising:

a frame including a tape storage section;

a plurality of guide rollers disposed on said frame, said guide rollers defining a tape path;

a tape transport unit including a pair of transport rollers and a drive motor coupled to at least one of said transport rollers;

a music generation unit disposed in the tape path, said music generation unit including a pair of feed rollers for feeding a tape through said music generation unit, a tape feed motor coupled to at least one of said feed rollers, and a plurality of reeds arranged to engage holes in a tape being fed by said feed rollers; and a guide member disposed in the tape storage section at a position where the tape path enters the tape storage section, said guide member having a restraining portion comprising an upward projection to hinder horizontal movement of a tape traversing the tape path so that accordion-like folds are formed in the portion of the tape within the tape storage section, wherein said guide member has a first section bounded by one end of said guide member and a first bend in said guide member, a second section bounded by the first bend and a second bend in said guide member, and a third section bounded by the second bend and the other end of said guide member, wherein the second section is shorter than the first section and the third section is shorter than the second section, and wherein the third section is the restraining portion.

7. A musical device comprising:

a frame including a tape storage section;

a plurality of guide rollers disposed on said frame, said guide rollers defining a tape path;

a tape transport unit including a pair of transport rollers and a drive motor coupled to at least one of said transport rollers;

a music generation unit disposed in the tape path, said music generation unit including a pair of feed rollers for feeding a tape through said music generation unit, a tape feed motor coupled to at least one of said feed rollers, and a plurality of reeds arranged to engage holes in a tape being fed by said feed rollers;

a guide member disposed in the tape storage section at a position where the tape path enters the tape storage section, said guide member having a restraining portion comprising an upward projection to hinder horizontal movement of a tape traversing the tape path so that accordion-like folds are formed in the portion of the tape within the tape storage section; and at least one movable figurine attached to said frame and a figurine motor coupled to said figurine to cause it to move, wherein said movable figurine comprises at least one moveable appendage and a rotatable shaft extending along a central axis of said movable figurine.

8. A device according to claim 7, further comprising a first pulley attached to said rotatable shaft of said movable figurine, a drive shaft attached to said frame, a second pulley attached to said drive shaft, an endless belt for coupling said first and second pulleys, and at least one gear for coupling said drive shaft to said figurine motor.

9. A musical device comprising:

a frame including a tape storage section;

a plurality of guide rollers disposed on said frame, said guide rollers defining a tape path;

a tape transport unit including a pair of transport rollers and a drive motor coupled to at least one of said transport rollers;

a music generation unit disposed in the tape path, said music generation unit including a pair of feed rollers for feeding a tape through said music generation unit, a tape feed motor coupled to at least one of said feed rollers, and a plurality of reeds arranged to engage holes in a tape being fed by said feed rollers;

a guide member disposed in the tape storage section at a position wheat a position where the tape path enters the tape storage section, said guide member having a restraining portion comprising an upward projection to hinder horizontal movement of a tape traversing the tape path so that accordion-like folds are formed in the portion of the tape within the tape storage section, wherein said guide member folds the tape within the tape storage section so that folded edges alternately face up and down; and at least one movable figurine attached to said frame and a figurine motor coupled to said figurine to cause it to move, wherein said plurality of guide rollers are disposed so that the tape path includes a plurality of bends and so that a portion of the tape path is adjacent to said movable figurine.

10. A method for generating music using a tape loop having a plurality of holes, said method comprising the steps of:

transporting the tape loop along a tape path defined by a plurality of rollers;

feeding the tape loop through a music generation unit disposed in the tape path; and folding a portion of the tape loop to form uniform, accordion-like folds, the tape loop being folded so that folded edges alternately face up and down.

11. A method according to claim 10, further comprising the step of moving a plurality of movable figurines during said transporting step.

12. A method according of claim 10, wherein the tape loop has periodic creases on alternate sides of the tape and wherein said folding step comprises hindering movement of a portion of the tape loop becomes folded along the creases in the hindered portion of the tape loop.

13. A method for generating music using a tape loop having a plurality of holes, said method comprising the steps of:

transporting the tape loop along a tape path defined by a plurality of rollers;

feeding the tape loop through a music generation unit disposed in the tape path;

folding a portion of the tape loop to form uniform, accordion-like folds so that folded edges alternately face up and down; and moving a plurality of movable figurines during said transporting step, wherein said transporting step comprises transporting the tape loop so that a portion of the tape path is adjacent to each of the movable figurines.

14. A musical device for generating music using a tape loop having a plurality of holes, said device comprising:

means for transporting the tape loop along a tape path, said means for transporting including a plurality of guide rollers for defining the tape path;

means for generating music using the plurality of holes in the tape loop, disposed in the tape path; and means for hindering movement of the tape loop to fold the tape loop so that folded edges alternately face up and down.

15. A device according to claim 14, further comprising at least one movable figurine and means for moving said movable figurine during the transporting of the tape loop.

16. A device according to claim 14, wherein the tape loop has periodic creases on alternate sides of the tape and wherein said means for hindering comprises means for hindering movement of a portion of the tape loop so that hindered portion of the tape loop becomes folded along the creases in the hindered portion of the tape loop.

17. A device according to claim 14, further comprising a tape having a plurality of holes therein and having periodic creases on alternate sides, said tape forming a continuous loop having a length greater than the length of the tape path, wherein said means for hindering causes the tape to fold along the periodic creases to form uniform, accordion-like folds.

18. A musical device for generating music using a tape loop having a plurality of holes, said devices comprising:

means for transporting the tape loop along a tape path, said means for transporting including a plurality of guide rollers for defining the tape path;

means for generating music using the plurality of holes in the tape loop, disposed in the tape path; and means for hindering movement of the tape loop to folded the tape loop so that folded edges alternately face up and down; and at least one movable figurine and means for moving said movable figurine during the transporting of the tape loop, wherein said guide rollers are disposed so that a portion of the tape path is adjacent to said movable figurine.

19. A musical device comprising:

a frame including a tape storage section;

a tape transport unit for transporting a tape loop along a tape path within said frame;

means for generating music disposed in the tape path; and a guide member disposed in the tape storage section, said guide member having a restraining portion comprising an upward projection for hindering horizontal movement of the tape loop to fold the tape loop within the tape storage section so that folded edges alternately face up and down.

20. A device according to claim 19, further comprising at least one movable figurine and means for moving said movable figurine during the transporting of the tape loop.

21. A device according to claim 19, wherein the tape loop has periodic creases on alternate sides of the tape and wherein said guide member hinders movement of a portion of the tape loop so that the hindered portion of the tape loop becomes folded along the creases in the hindered portion of the tape loop.

22. A device according to claim 19, further comprising a tape having a plurality of holes therein and having periodic creases on alternate sides, said tape forming a continuous loop having a length greater than the length of the tape path, wherein the restraining portion of said guide member causes the tape to fold along the periodic creases to form uniform, accordion-like folds.

23. A musical device according to claim 19, wherein said guide member is substantially L-shaped.

24. A musical device according to claim 19, wherein said guide member includes first guide portion for guiding the tape loop in a first direction substantially downwardly within the tape storage section sand said restraining portion guides the tape loop in a second direction substantially opposite to the first direction.

25. A device according to claim 19, wherein said movable figure is disposed adjacent to a tape path of a tape loop of said device.

26. A musical device comprising:

a frame including a tape storage section;

a tape transport unit for transporting a tape loop along a tape path within said frame;

means for generating music disposed in the tape path;

a guide member disposed in the tape storage section, said guide member having a restraining portion for hindering movement of the tape loop to fold the tape loop within the tape storage section so that folded edges alternately face up and down; and at least one movable figurine and means for moving said movable figurine during the transporting of the tape loop, wherein said tape transport unit includes a plurality of guide rollers for defining the tape path, said guide rollers being disposed so that a portion of the tape path is adjacent to said movable figurine.

27. A method for generating music using a tape loop having a plurality of holes, said method comprising the steps of:

transporting the tape loop along a tape path defined by a plurality of rollers:

feeding the tape loop through a music generation unit deposed in the tape path; and folding a portion of the tape loop to form uniform, accordion-like folds, the tape loop being folded in a horizontal, side-to-side manner.

wherein said folding step comprises folding the tape loop using a guide member which is substantially L-shaped.

28. A method for generating music using a tape loop having a plurality of holes, said method comprising the steps of:

transporting the tape loop along a tape path defined by a plurality of rollers;

feeding the tape loop through a music generation unit disposed in the tape path; and folding a portion of the tape loop to form uniform, according-like folds, the tape loop being folded in a horizontal, side-to-side manner, wherein said folding step comprises folding the tape using a guide member which includes a first guide portion for guiding the tape loop in a first direction substantially downwardly within a tape storage section and a restraining portion for guiding the tape loop in a second direction substantially opposite to the first direction.

29. A musical device for generating music using a tape loop having a plurality of holes, said device comprising:

means for transporting the tape loop along a tape path, said means for transporting including a plurality of guide rollers for defining the tape path;

means for generating music using the plurality of holes in the tape loop, disposed in the tape path; and means for hindering movement of the tape loop to fold the tape loop in a horizontal, side-to-side manner, wherein said means for hindering comprising a guide member is substantially L-shaped.

30. A musical device for generating music using a tape loop having a plurality of holes, said device comprising:

means for transporting the tape loop along a tape path, said means for transporting including a plurality of guide rollers for defining the tape path;

means for generating music using the plurality of holes in the tape loop, disposed in the path; and means for hindering movement of the tape loop to fold the tape loop in a horizontal, side-to side manner, wherein said means for hindering comprises a guide member which includes a first guide portion for guiding the tape loop in a first direction substantially downwardly within a tape storage section and a restraining portion for guiding the tape loop in a second direction substantially opposite to the first direction.

31. A musical device comprising:

a frame including a tape storage section for storing a tape;

a music generation unit disposed in a tape path of the tape, said music generation unit including a pair of feed rollers for feeding a tape through said music generation unit, a tape feed motor coupled to at least one of said feed rollers, and a plurality of reeds arranged to engage holes in a tape being fed by said feed rollers; and a guide member disposed in the tape storage section at a position where the tape path enters the tape storage section, said guide member having a restraining portion comprising an upward projection to hinder horizontal movement of a tape traversing the tape path so that accordion-like folds are formed in the portion of the tape within the tape storage section, wherein said guide member folds the tape within the tape storage section so that folded edges alternately face up and down.

32. A device according to claim 31, further comprising:

a tape having a plurality of holes therein and having periodic creases on alternate sides, said tape forming a continuous loop having a length greater than the length of the tape path.

33. A device according to claim 31, wherein said guide member has a first section bounded by one end of said guide member and a first bend in said guide member, a second section bounded by the first bend and a second bend in said guide member, and a third section bounded by the second bend and the other end of said guide member, wherein the second section is shorter than the first section and the third section is shorter than the second section, and wherein the third section is the restraining portion.

34. A device according to claim 31, wherein said guide member extends from a surface of the tape storage section into the tape storage section.

35. A device according to claim 31, further comprising at least one movable figurine attached to said frame and a figurine motor coupled to said figurine to cause it to move.

36. A device according to claim 35, wherein said movable figure is disposed adjacent to a tape path of said device.

37. A device according to claim 35, wherein said movable figurine comprises at least one movable appendage and a rotatable shaft extending along a central axis of said movable figurine.

38. A device according to claim 37, further comprising a first pulley attached to said rotatable shaft of said movable figurine, a drive shaft attached to said frame, a second pulley attached to said drive shaft, an endless belt for coupling said first and second pulleys, and at least one gear for coupling said drive shaft to said figurine motor.

39. A musical device according to claim 31, wherein said guide member is substantially L-shaped.

40. A musical device according to claim 31, wherein said guide member includes a first guide portion for guiding the tape in a first direction substantially downwardly within the tape storage section and said restraining portion guides the tape in a second direction substantially opposite to the first direction.

41. A method for generating music using tape loop having a plurality of holes, said method comprising the steps of:

transporting the tape loop along a tape path;

feeding the tape loop through a music generation unit disposed in the tape path; and folding a portion of the tape loop to form uniform, according-like folds, the tape being folded so that folded edges alternately face up and down.

42. A method according to claim 41, further comprising the step of moving a plurality of movable figurines during said transporting step.

43. A method according to claim 41, further comprising the step of moving a plurality of movable figurines, each disposed adjacent a tape path of a tape loop, during said transporting step.

44. A method according to claim 41, wherein the tape loop has periodic creases on alternate sides of the tape and wherein said folding step comprises hindering movement of a portion of the tape loop so that the hindered portion of the tape loop becomes folded along the creases in the hindered portion of the tape loop.

45. A method for generating music using a tape loop having a plurality of holes, said method comprising the steps of:

transporting the tape loop along a tape path;

feeding the tape loop through a music generation unit disposed in the tape path; and folding a portion of the tape loop to form uniform, accordion-like folds, the tape loop being folded in a horizontal, side-to-side manner, wherein said folding step comprises folding the tape loop using a guide member which is substantially L-shaped.

46. A method for generating music using a tape loop having a plurality of holes, said method comprising the steps of:

transporting the tape loop along a tape path;

feeding the tape loop through a music generation unit disposed in the tape path; and folding a portion of the tape loop to form uniform, accordion-like folds, the tape loop being folded in a horizontal, side-to-side manner, folding a portion of the tape loop to form uniform, accordion-like folds, the tape loop being folded in a horizontal, side-to-side manner, wherein said folding step comprising folding the tape loop using a guide member which includes a first guide portion for guiding the tape loop in a first direction substantially downwardly within a tape storage section and a restraining portion for guiding the tape loop in a second direction substantially opposite to the first direction.

47. A musical for generating music using a tape loop having a plurality of hole, said device comprising:

means for transporting the tape loop along a tape path;

means for generating music using the plurality of holes in the tape loop, disposed in the tape path; and means for hindering movement of the tape loop to fold the tape loop so that folded edges alternately face up and down.

48. A device according claim 47, further comprising at least one movable figurine and means for moving said movable figurine during the transporting of the tape loop.

49. A device according to claim 48, wherein said movable figurines are disposed adjacent a tape path of a tape loop of said device.

50. A device to claim 47, wherein the tape loop has periodic creases on alternate sides of the tape and wherein said means for hindering comprises means for hindering movement of a portion of the tape loop becomes folded along the crease in the hindered portion of the tape loop.

51. A device according to claim 47, further comprising a tape loop having a plurality of holes therein and having periodic creases on alternate sides, said tape loop forming a continuous loop having a length greater than the length of the tape path, wherein said means for hindering creases said tape loop to fold along the periodic creases to form uniform, accordion-like folds.

52. A musical device for generating music using a tape loop having a plurality of holes, said device comprising:

means for transporting the tape loop along a tape path;

means for generating music using the plurality of holes in the tape loop, disposed in the tape path; and means for hindering movement of the tape loop to fold the tape loop in a horizontal, side-to-side manner, wherein said means for hindering comprises a guide member which is substantially L-shaped.

53. A musical device for generating music using a tape loop having a plurality of holes, said device comprising:

means for transporting the tape loop along a tape path;

means generating music using the plurality of holes in the tape loop, disposed in the tape path; and means for hindering movement of the tape loop to fold the tape loop in a horizontal, side-to-side manner, wherein said means for hindering comprises a guide member which includes a first guide portion for guiding the tape loop in a first direction substantially downwardly within a tape storage section and restraining portion for guiding the tape loop in a second direction substantially opposite to the first direction.

54. A musical device comprising:

a frame including a tape storage section for storing a tape;

a music generation unit disposed in a tape path of the tape, said music generation unit including a pair of feed rollers for feeding a tape through said music generation unit, a tape feed motor coupled to at least one of said feed rollers, and a plurality of reeds arranged to engage holes in a tape being fed by said feed rollers;

a guide member disposed in the tape storage section at a position where the tape path enters the tape storage section, said guide member having a restraining portion comprising an upward projection to hinder horizontal movement of a tape traversing the tape path so that accordion-like folds are formed in the portion of the tape with the tape storage section, wherein said guide member folds the tape within the tape storage section so that folded edges alternately face up and down; and at least one movable figurine attached to said frame and a figurine motor coupled to said figurine to cause it to move, wherein said movable figure is disposed adjacent to a tape path of said device.

55. A method for generating music using a tape loop having a plurality of holes, said method comprising the steps of:

transporting the tape loop along a tape path;

feeding the tape loop through a music generation unit disposed in the tape path; and folding a portion of the tape loop to form uniform, accordion-like folds so that folded edges alternately face up and down; and moving a plurality of movable figurines, each disposed adjacent a tape path of a tape loop, during said transporting step.

56. A musical device for generating music using a tape loop having a plurality of holes, said device comprising:

means for transporting the tape loop along a tape path;

means for generating music using the plurality of holes in the tape loop, disposed in the tape path; and means for hindering movement of the tape loop to fold the tape loop so that folded edges alternate face up and down; and at least one movable figurine and means for moving said movable figurine during the transporting of the tape loop, wherein said at least one movable figurine is disposed adjacent a tape path of a tape loop of said device.

* * * * *

UNITED STATES PATENT AND TRADEMARK OFFICE

CERTIFICATE OF CORRECTION

PATENT NO. : 5,698,801

DATED : December 16, 1997

INVENTOR(S) : HUANG MENG-SUEN

It is certified that error appears in the above-identified patent and that said Letters Patent is hereby corrected as shown below:

COLUMN 5

Line 26, "comb" should read --comb 120--.

COLUMN 10

Line 33, "alternated" should read --alternate--.

COLUMN 11

Line 56, "wheat a position" should be deleted.

COLUMN 12

Line 21, "loop" should read --loop so that the hindered portion of the tape loop--.

Line 56, "that" should read --that the--.

COLUMN 13

Line 44, "includes" should read --includes a--.

UNITED STATES PATENT AND TRADEMARK OFFICE

CERTIFICATE OF CORRECTION

PATENT NO. : 5,698,801 Page 2 of 3

DATED : December 16, 1997

INVENTOR(S) : HUANG MENG-SUEN

It is certified that error appears in the above-identified patent and that said Letters Patent is hereby corrected as shown below:

COLUMN 14

Line 26, "tape" should read --tape loop--.

Line 43, "member" should read --member which--.

Line 50, "the path" should read --the tape path--.

COLUMN 16

Lines 24-26 should be deleted.

Line 34, "musical" should read --musical device--.

Line 35, "hole" should read --holes--.

Line 51, "loop" should read --loop so that the hindered portion of the tape loop--.

Line 52, "crease" should read --creases--.

Line 57, "creases" should rease --causes--.

COLUMN 17

Line 13, "and" should read --and a--.

Line 31, "with" should read --within--.

UNITED STATES PATENT AND TRADEMARK OFFICE

CERTIFICATE OF CORRECTION

PATENT NO. : 5,698,801 Page 3 of 3

DATED : December 16, 1997

INVENTOR(S) : HUANG MENG-SUEN

It is certified that error appears in the above-identified patent and that said Letters Patent is hereby corrected as shown below:

COLUMN 18

Line 25, "alternate" should read --alternately--.

Signed and Sealed this

Seventh Day of July, 1998

Bruce Lehman

*Attest:*

BRUCE LEHMAN

*Attesting Officer*

*Commissioner of Patents and Trademarks*